US006135302A

United States Patent [19]

Rosenthal et al.

[11] Patent Number: 6,135,302

[45] Date of Patent: Oct. 24, 2000

[54] TAMPER-PROOF CLOSURE

[75] Inventors: Karl-Heinz Rosenthal, Reichshof; Norbert Filip, Wiehl, both of Germany

[73] Assignee: Innocos Innovative Verpackungen fur die Kosemtische Industrie GmbH, Germany

[21] Appl. No.: 09/068,612

[22] PCT Filed: Nov. 7, 1996

[86] PCT No.: PCT/DE96/02143

§ 371 Date: Mar. 15, 1999

§ 102(e) Date: Mar. 15, 1999

[87] PCT Pub. No.: WO97/17262

PCT Pub. Date: May 15, 1997

[30] Foreign Application Priority Data

Nov. 10, 1995 [DE] Germany ..... 195 41 990

[51] Int. Cl.[7] ..... B65D 39/00; B65D 55/02

[52] U.S. Cl. ..... 215/230; 215/250; 215/253

[58] Field of Search ..... 215/230, 250, 215/252, 253

[56] References Cited

U.S. PATENT DOCUMENTS 4,724,972 2/1988 Marcus ..... 215/253

4,986,430 1/1991 Dutt ..... 215/253

*Primary Examiner*—Stephen K. Cronin
*Assistant Examiner*—Joe Merek
*Attorney, Agent, or Firm*—Reising, Ethington, Barnes, Kisselle, Learman & McCulloch, P.C.

[57] ABSTRACT

The invention concerns a tamper-proof seal intended to show the intact state of a container seal of a closure cap which bulges over a container wall and a container aperture provided in the container wall and capable of being detachably joined to the closure cap. In the closed state, the peripheral border of the closure cap is close to or in contact with the container. The proposed seal consists of at least one indicator element (4) which in the closed state is located between the container wall and the closure cap; a first end of the indicator element (4) projects radially underneath the closure cap towards the central line of the container and has a retaining element with a branch (43) extending upwards transversely to the longitudinal axis of the indicator element (4), while a second end projects radially outwards. In order to simplify the fitting of such indicator elements and reduce the number of parts required, it is proposed that the indicator element (4) should be connected by its first end on the inner side of the closure cap (1) to at least one securing device and that the securing device should be located on the upper end of the retaining device.

5 Claims, 3 Drawing Sheets

TAMPER-PROOF CLOSURE

FIELD OF THE INVENTION

This invention relates to closures for containers; more particularly, it relates to such closures which include indicator elements for producing an indication that the closure has been opened or tampered with.

BACKGROUND OF THE INVENTION

Indicator elements of this kind have been known For a long time and serve as a control device for determining whether a container is in its originally sealed state, or whether it has previously been opened. A control device of this kind can prove to be important from the point of view of hygiene, e.g. in connection with foods, and also in relation to aspects of preservation, e.g. for drugs and cosmetics. The indicator elements known from the prior art are rooted in a common functional principle based on making the previous opening of a closed container apparent by separating the segments of the indicator element from one another at predetermined breaking points provided for this purpose. If the closure cap is unscrewed, the indicator elements fall out, thus making it clear that the seal is no longer intact.

Tamper-proof seals of this kind are associated with the disadvantage that their fitting on the container requires several process steps. One or more indicator elements must first be positioned on the container wall and the closure cap must then be screwed on.

SUMMARY OF THE INVENTION

Thus, the problem solved by the present invention is that of simplifying the design and fitting of a generic tamper-proof seal.

According to the invention, this problem is solved in that the first end of the indicator element is attached to the inside of the closure cap by at least one securing device. Preferably, a retaining device or latch is provided to keep the indicator element from falling out of the cap unless the cap is loosened. Preferably also the securing device is mounted on the upper end of the retaining device.

The design of the tamper-proof seal according to the invention substantially simplifies its assembly. Now, only the closure cap need be fitted on the container. In this step, the connection between the indicator element and the closure cap is released so that the indicator element comes to rest between the container wall and the closure cap, without falling out. If the closure cap is loosened, the indicator element falls out.

The assembly of the tamper-proof seal is simplified in that it now requires only one process step. In addition, the indicator element is not a separate part.

The tamper-proof seal is preferably designed such that, in the area of the retainer, the axial distance from the edge of the closure cap to the retainer is less than the axial distance between the edge of the closure cap and the top side of the indicator element, when it just rests on the container wall with its maximum contact surface. This ensures that the retainer is torn off as soon as the indicator element rests on the container wall with its maximum contact surface. In this context, the branch prevents the indicator element from falling out before the closure cap has been fully mounted and while there is still a gap between the edge of the closure cap and the top side of the indicator element.

In another, preferred configuration, the branch is shorter than the axial distance from the retainer to the edge of the closure cap.

When the closure cap is fitted on the container wall, the indicator element is wedged between the container wall and the edge of the closure cap. In this context, the indicator element forms a lever arm which rotates about the contact point located on the inside edge of the cap edge and touching the top side of the indicator element. As the branch is shorter than the axial distance from the bottom side of the closure cap to the retention surface, the further axial fitting of the closure cap breaks the retainer between the indicator element and the closure cap. In this configuration, the indicator again lies between the edge of the closure cap and the container wall. It is either prevented from falling out by the branch, or wedged between the container wall and the edge of the closure cap.

DESCRIPTION OF THE DRAWINGS

The invention is illustrated in the drawings and described in detail below based on the drawings. The drawings show the following.

BEST MODE FOR CARRYING OUT THE INVENTION

Figure 1:
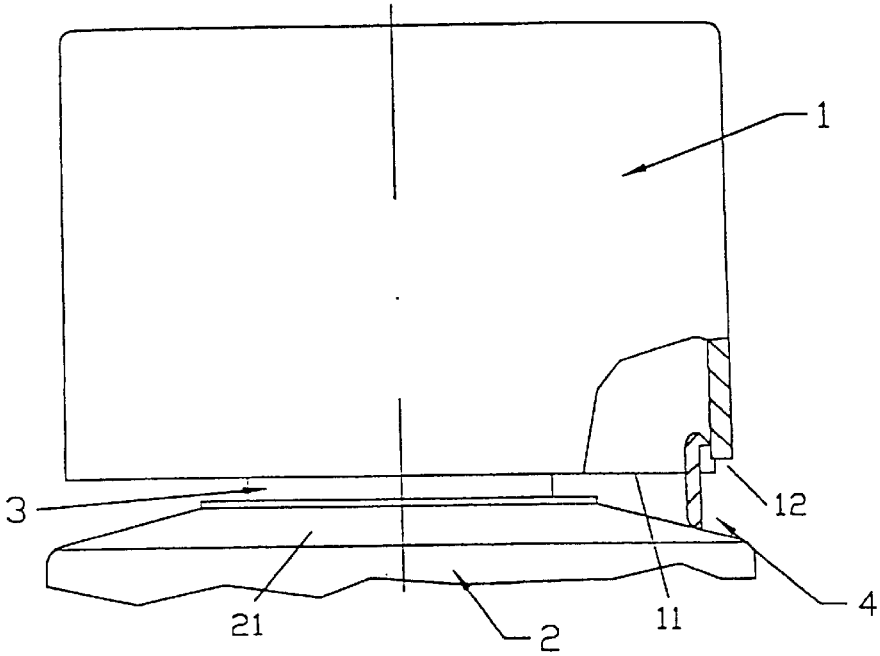
FIGS. 1 to 3 Different phases during the fitting of a closure cap on a corresponding container (with partial cross-sections), FIG. 4 A top view of the tamper-proof seal from FIG. 3, and FIG. 5 A detailed illustration of an alternative configuration of the indicator element.

According to the drawings, the tamper-proof seal consists of a closure cap 1 which can be detachably fitted to a container aperture 3, designed as a neck, on a container 2. An indicator element 4 is located on the inside of the closure cap in the area of peripheral border 11 of closure cap 1.

Container 2 is provided with a shoulder-like, bevelled container wall 21 surrounding the container aperture. In the present configuration, container 2, container wall 21 and container aperture 3 are designed as a single injection-moulded part. The container aperture has a thread (not shown) on the outside of its neck, onto which closure cap 1 can be screwed by way of an extension corresponding to the thread. Alternatively, this connection can also be achieved using a snap-on closure or other suitable, separable connections.

Figure 5:
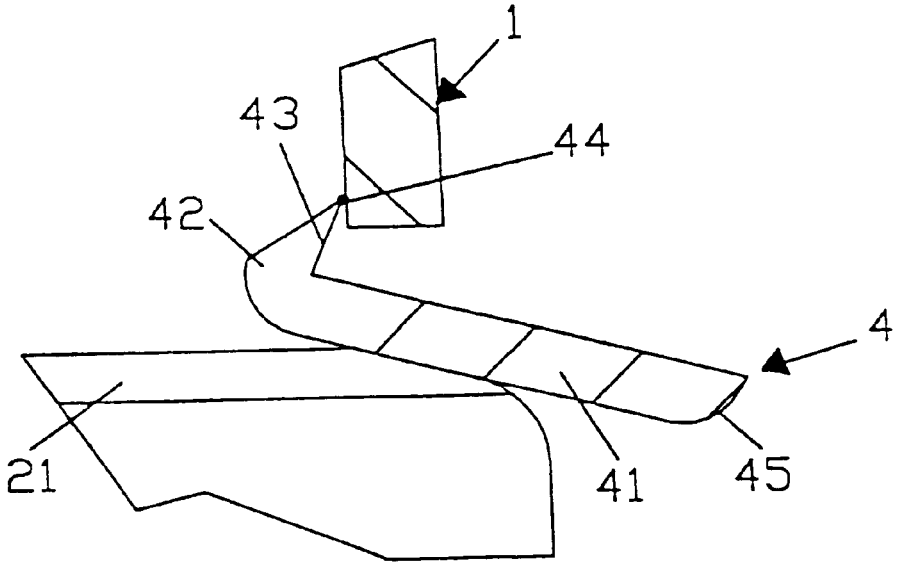

FIG. 5 shows the detailed design of the indicator element. Indicator element 4 has a longitudinal leg 41 and a retaining device designed as a retaining catch 42. Retaining catch 42 has a branch 43 running transverse to the longitudinal axis of the indicator element. The upper end of the retaining catch of indicator element 4 is mounted on the inside of closure cap 1 by way of a retainer designed as retention point 44. Closure cap 1 and indicator element 4 are designed as a single injection-moulded part and connected to one another by retention point 44. Alternatively, this connection can also be made by way of a film joint or other suitable means. However, realising the connection using retention point 44 ensures that indicator element 4 can be properly positioned even with sharply curved closure caps 1. The second end of indicator element 4 has a bevel 45 on the side facing the centre axis of the closure cap.

Figure 2:
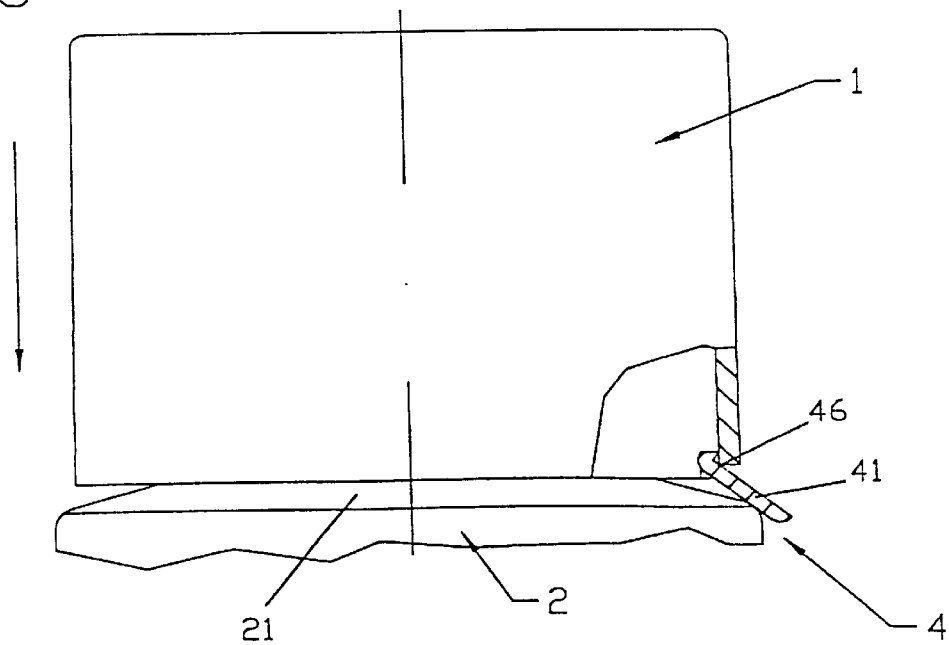
Figure 3:
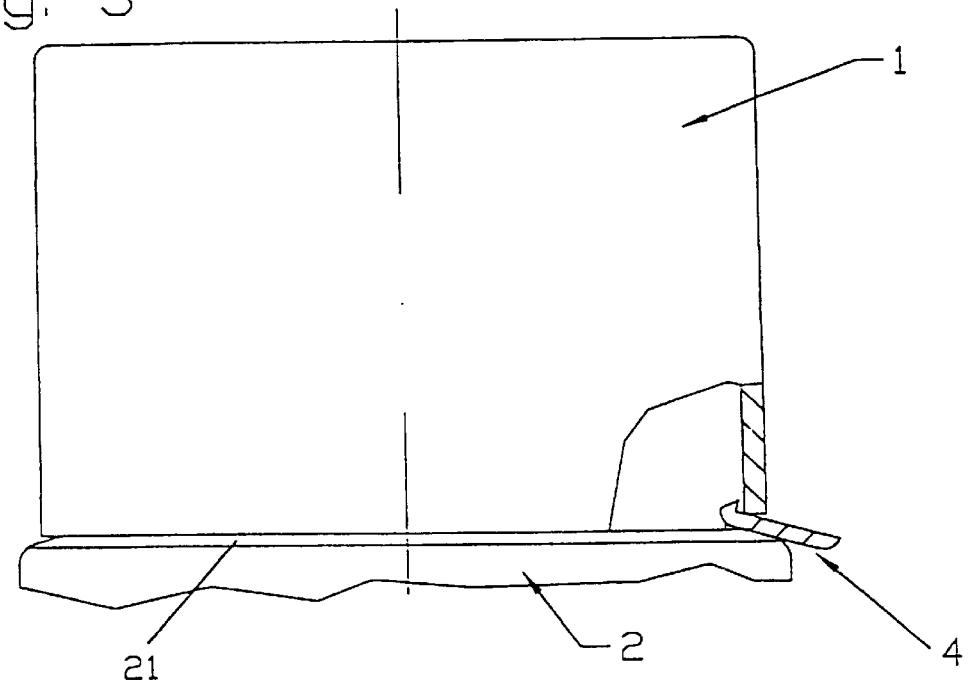

The following is a description of the closing of container 2 using closure cap 1 based on FIGS. 1 to 3, illustrating the function of indicator element 4. In FIG. 1, the closure cap has just been placed on container aperture 3. It has not yet been screwed on for sealing. Indicator element 4 is connected to closure cap 1 at retention point 44 and is hanging vertically downward. The second end of the indicator element has just come into contact with the surface of container wall 21 in the area of bevel 45.

In FIG. 2, the closure cap has been partially screwed on, so that it has moved towards container wall 21 along the longitudinal axis of the container. Due to the bevel and the slant of container wall 21, the indicator element has been pushed outward from the centre line of the container during this process. The slant and bevel 45 ensure that the indicator element always folds outward when the cap is closed, so that it is positioned between the edge of closure cap 1 and container wall 21. The bottom side of the longitudinal leg of the indicator element rests on container wall 21. The top side of longitudinal leg 41 of the indicator element is in contact with the inside edge of peripheral border 11 of closure cap 1. As retention point 44 is still attached to the inside of closure cap 1, further closing generates a torque about contact point 46. Due to the lever, further rotation of the closure cap in the closing direction causes the indicator element 4 to separate from closure cap 1 at retention point 44. Retaining catch 42 ensures that indicator element 4 does not slip out from under closure cap 1 before container 2 is closed, or before indicator element 4 is wedged between peripheral border 11 of the closure cap and container wall 21. This case is illustrated in FIG. 3.

Therefore, the geometry and material properties of the retention point or the retaining device must be designed such that it is certain to be destroyed during closing, but not before closure cap 1 has sufficiently secured indicator element 4.

Figure 4:
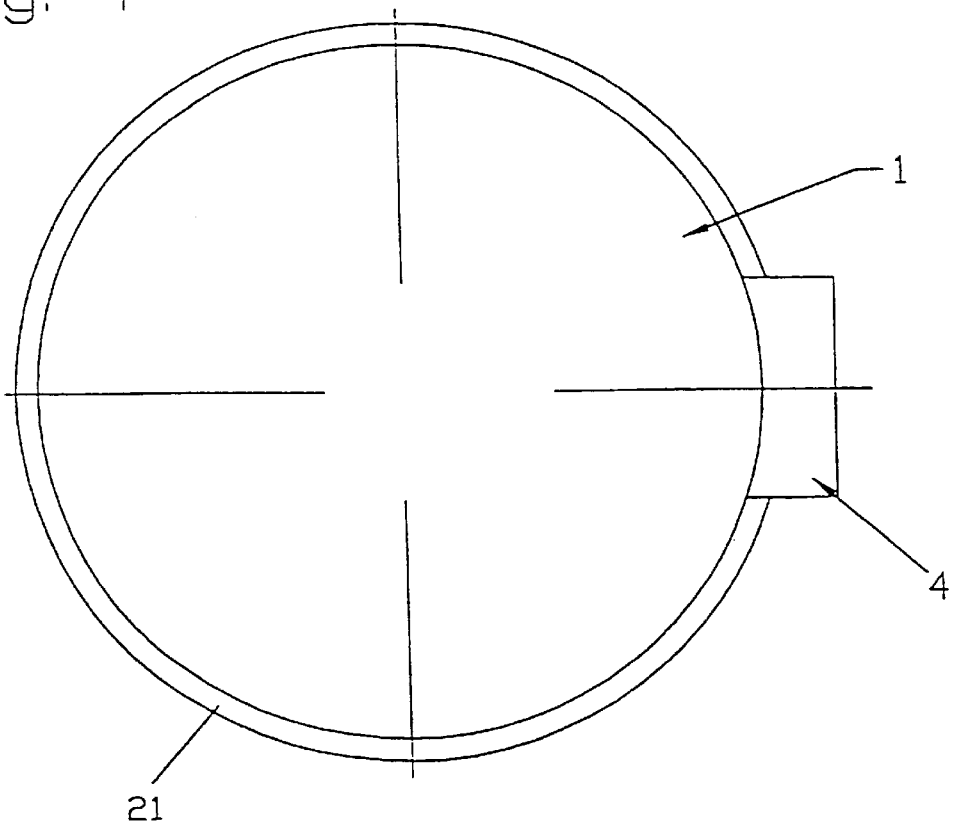

FIG. 4 shows a top view of the tamper-proof seal according to the invention in the closed state. The figure clearly shows the top side of longitudinal leg 41 of indicator element 4, which is wedged between container wall 21 and closure cap 1. If closure cap 1 is now slightly rotated in the opening direction, the indicator element falls out due to its own weight. This indicates to third parties that the container has been opened. Of course, the indicator element can be of any suitable shape, for example round, triangular or very long. In addition, several indicator elements can be positioned around peripheral border 11 of closure cap 1, in order to prevent the indicator elements from being reinserted after opening.

In the configuration of the tamper-proof seal according to the invention shown in FIG. 5, indicator element 4 is not wedged between the inside edge of peripheral border 11 of closure cap 1 and the container wall during closing. In this case, retention point 44 is designed such that indicator element 4 comes to rest on container wall 21 without the top side of longitudinal leg 41 of indicator element 4 coming into contact with peripheral border 11 of the closure cap. However, the continuation of the closing motion of closure cap 1 also destroys retention point 44 in this case, thus separating indicator element 4 from the closure cap.

Peripheral border 11 of closure cap 1 has a recess 12 in the area of indicator element 4, whose geometry roughly corresponds to the geometry of indicator element 4. This recess 12 provides additional hold for indicator element 4 against displacement.

The tamper-proof seal according to the invention simplifies the manufacture and assembly of seals of this kind, as the closure cap and the indicator element can be designed as a single injection-moulded part. Now, only the closure cap need be screwed onto the container. No additional process step is necessary to insert the indicator element. The bevel on the second end of the indicator element ensures that it is folded outward from the centre line of the container even if the container wall runs transverse to, or flush with, the closure cap.

EQUIVALENT AND ALTERNATE DESIGNS

The indicator element is preferably held in place on the inside of the closure cap by a retention point. In this way, only a minimum amount of material is necessary for the retainer and no great force need be applied to destroy the retainer when fitting the closure cap. In addition, this makes it easy to also attach curved indicator elements perfectly.

The retention point is preferably located near the edge of the lower area of the closure cap, so that indicator elements can have small dimensions on the surface inside the closure cap. Of course, this also applies to any other form of retainer if a retention point is not used.

A corresponding design of the closure cap and the container wall also make in conceivable for the indicator element to be mounted on the outside of the closure cap. In this context, it must be possible to move the indicator element from the outside towards the center line of the container into the gap between the closure cap and the container wall during fitting of the closure cap on the container wall.

In a particularly advantageous configuration of the tamper-proof seal according to the invention, the indicator element is integrally molded on the closure cap in one piece, meaning that the closure cap and the indicator element are designed as a single injection-molded part. This represents the simplest form of the tamper-proof seal according to the invention. Separate production steps and assembly steps are completely eliminated. The indicator element and the closure cap are manufactured and sold as one component.

In the particularly preferred configuration, the tamper-proof seal is made of plastic. Of course, other suitable materials, such as sheet metal, can also be used. The closure cap itself can be of all common and suitable shapes. For example, it can have a round, square or triangular cross-section.

In order to better secure the indicator element, the closure cap can be provided with a recess on the edge in the area of the indicator element, where the geometry of the recess roughly corresponds to the geometry of the indicator element. This protects the indicator element against unintentional displacement which could cause it to fall out of the closure cap.

The tamper-proof seal can have several indicator elements, positioned as desired around the peripheral border of the closure cap. If, for example three indicator elements are positioned at angles of 120° on a closure cap with a round cross-section, it is impossible for one person to reinsert the indicator elements after opening the tamper-proof seal. The total number of indicator elements is limited only by the geometry of the closure cap and the container wall. For example, the indicator elements can also be positioned around the entire circumference of the closure cap in wreath-like fashion. The geometry and dimensions of the indicator element(s) can be selected as desired.

The closure cap is preferably mounted on the container aperture by way of a screw connection. Alternatively, the closure cap can be mounted on the container aperture by way of a snap-on closure or other suitable, separable connections. Thus, the tamper-proof seal according to the invention can be used with all conventional caps and containers, without having to change the molds used to manufacture the containers.

The second end of the indicator element is expediently rounded or bevelled on the side facing the center axis of the closure cap, this ensuring that, even in the case of horizontal container walls, the indicator element folds radially outward from the center line of the container and comes to rest between the edge of the closure cap and the container wall when fitting the closure cap on the container. The tamper-proof seal according to the invention can be used both with containers whose wall protrudes radially outward below the closure cap and with containers which are flush with the closure cap.

The tamper-proof seal according to the invention can be designed such that the indicator element can be wedged between the edge of the closure cap and the container wall in the closed state. This makes it impossible to push the indicator element radially inward or to change its position in some other way. However, if the indicator element is not wedged in, it is prevented from falling out from underneath the closure cap by the branch of the retaining device.

Although the description of this invention has been given with reference to a particular embodiment, it is not to be construed in a limiting sense. Many variations and modifications of the invention will now occur to those skilled in the art. For a definition of the invention, reference is made to the appended claims.

What is claimed is:

1. In the combination of a container (2) and a closure cap (1) for said container, said container being of the type having a vertical axis and comprising a container wall (21) defining a container aperture (3) and having a wall portion extending transversely of said vertical axis said closure cap (1) being detachably joined with the container, (2) and movable between a partially closed state and a fully closed state on said container and having a peripheral edge disposed in a confronting relationship with the container wall (21) when the closure cap (1) is in the fully closed state, the improvement comprising:

an indicator element (4) having an upper end and a lower end with a retaining catch (42) on the upper end, said indicator element being attached to the inside of the closure cap (1) by a retainer (44), said indicator element (4) being suspended by said retainer (44) from said closure cap (1), and being long enough so that its lower end engages the transversely extending wall portion when the closure cap (1) is in the partially closed state thereby exerting a force on said indicator element (4) for detaching it from the closure cap when the closure cap is placed in the fully closed state, said indicator element (4) being disposed between the container wall (21) and the closure cap (1) when the closure cap is in the fully closed state, said indicator element (4) being free to fall from the closure cap and container due to its own weight when said closure cap (1) is opened.

2. A tamper-proof closure as defined in claim 1 wherein:

said upper end of said indicator element (4) extends radially toward the vertical axis of the container underneath the closure cap (1) and has a retaining catch (42) with a branch (43) extending upward transversely to the length of the indicator element (4) and said upper end of said indicator extends radially outward, and the axial distance from the edge of the closure cap (1) to the retainer is less than the axial distance between the edge (11) of the closure cap (1) and the upper side of the indicator element (4), when it just rests on the container wall (21) with its maximum contact surface, so that the indicator element falls out due to its own weight when the closure cap (1) is opened for the first time.

3. A tamper-proof closure as defined in claim 1 wherein:

said upper end of said indicator element (4) extends radially toward the vertical axis of the container underneath the closure cap (1) and has a retaining catch (42) with a branch (43) extending upward transversely to the length of the indicator element (4) and said upper end of said indicator extends radially outward, and the branch (43) is shorter than the axial distance from the retainer (44) to the edge (11) of the closure cap (1), so that the indicator element falls out due to its own weight when the closure cap (1) is opened for the first time.

4. A temper-proof closure as defined in claims 1 or 2 or 3 wherein the closure cap (1) has a recess (12) on the edge (11) adjacent the indicator element (4), said recess having a shape and size substantially the same as the cross-section of the indicator element (4) for allowing the element to extend therethrough.

5. A tamper-proof seal according to one of the claims 1 or 2 or 3 wherein the lower end of the indicator element (4) is bevelled on the side facing the vertical axis of the container.

* * * * *